US011578896B2

(12) United States Patent
Meng et al.

(10) Patent No.: US 11,578,896 B2
(45) Date of Patent: Feb. 14, 2023

(54) REFRIGERATION SYSTEM

(71) Applicants: Qingdao Haier Air-conditioning Electronic Co., Ltd, Shandong (CN); Haier Smart Home Co., Ltd., Shandong (CN)

(72) Inventors: Qingliang Meng, Qingdao (CN); Qiang Song, Qingdao (CN); Xueyan Tan, Qingdao (CN); Jiangbin Liu, Qingdao (CN); Jingsheng Liu, Qingdao (CN); Bing Wang, Qingdao (CN)

(73) Assignees: Qingdao Haier Air-conditioning Electronic Co., Ltd, Qingdao (CN); Haier Smart Home Co., Ltd., Qingdao (CN)

( * ) Notice: Subject to any disclaimer, the term of this patent is extended or adjusted under 35 U.S.C. 154(b) by 44 days.

(21) Appl. No.: 17/256,355

(22) PCT Filed: Jun. 14, 2019

(86) PCT No.: PCT/CN2019/091279
§ 371 (c)(1),
(2) Date: Dec. 28, 2020

(87) PCT Pub. No.: WO2020/211184
PCT Pub. Date: Oct. 22, 2020

(65) Prior Publication Data

US 2021/0270497 A1 Sep. 2, 2021

(30) Foreign Application Priority Data

Apr. 18, 2019 (CN) ..... 201910314874.7

(51) Int. Cl.
*F25B 1/00* (2006.01)

(52) U.S. Cl.
CPC ..... *F25B 1/005* (2013.01); *F25B 2400/07* (2013.01)

(58) Field of Classification Search
CPC ..... F25B 1/005; F25B 2400/07; F25B 1/06; F25B 2400/13
See application file for complete search history.

(56) References Cited

U.S. PATENT DOCUMENTS 6,000,233 A * 12/1999 Nishida ..... F25B 9/008 62/470
2017/0051957 A1* 2/2017 Shimasaki ..... F25B 43/02

FOREIGN PATENT DOCUMENTS

CN 102230681 A 11/2011
CN 202133171 U 2/2012
(Continued)

OTHER PUBLICATIONS

WO-2013140990-A1 Translation (Year: 2013).*
(Continued)

*Primary Examiner* — David J Teitelbaum
(74) *Attorney, Agent, or Firm* — Maier & Maier, PLLC

(57) ABSTRACT

A refrigeration system, comprising an evaporator, a condenser, a throttling device, a compressor, an economizer and an ejector, these devices together form a closed-loop refrigerant circulation loop, the ejector being connected to the economizer, and the ejector being provided on an exhaust side of the compressor. The structure enables the refrigeration system to realize the dual-stage boost, does not affect the stability of the compressor due to the instability of the airflow of the ejector, and does not affect the oil property of the compressor, thereby ensuring the operation safety of the compressor.

10 Claims, 3 Drawing Sheets

(56) References Cited

FOREIGN PATENT DOCUMENTS

| | | | | | |
|---|---|---|---|---|---|
| CN | 103322729 | A | | 9/2013 | |
| CN | 103471273 | A | | 12/2013 | |
| CN | 104019579 | A | | 9/2014 | |
| CN | 205860539 | U | | 1/2017 | |
| CN | 207180091 | U | | 4/2018 | |
| CN | 108224838 | A | | 6/2018 | |
| CN | 108344195 | A | | 7/2018 | |
| CN | 108981223 | A | | 12/2018 | |
| EP | 3102891 | A1 | | 12/2016 | |
| JP | 2004205154 | A | * | 7/2004 | ..... F25B 1/06 |
| WO | WO-2013140990 | A1 | * | 9/2013 | ..... F25B 40/00 |
| WO | 2017/146266 | A1 | | 8/2017 | |

OTHER PUBLICATIONS

English Translation of JP-2004205154-A (Year: 2004).*
International Search Report dated Jan. 19, 2020 in corresponding International Application No. PCT/CN2019/091279; 6 pages.

* cited by examiner

| working condition | | ordinary cooling system | | |
|---|---|---|---|---|
| evaporation temperature /℃ | condensation temperature /℃ | discharge temperature | volumetric cooling capacity | energy efficiency ratio |
| -10 | 56 | 105.885 | 2992 | 3.13 |
| -15 | 56 | 106.81 | 2595 | 2.86 |
| -20 | 56 | 107.72 | 2242 | 2.63 |
| -25 | 56 | 108.56 | 1934 | 2.42 |

Fig.2

| working condition | | two-stage compression cooling system | | |
|---|---|---|---|---|
| evaporation temperature /℃ | condensation temperature /℃ | discharge temperature | volumetric cooling capacity | energy efficiency ratio |
| -10 | 56 | 108.74 | 3109 | 3.18 |
| -15 | 56 | 111.58 | 2613 | 3.02 |
| -20 | 56 | 114.82 | 2388 | 2.74 |
| -25 | 56 | 118.55 | 2071 | 2.51 |

Fig.3

| working condition | | air-supplementing enthalpy-increasing cooling | | |
|---|---|---|---|---|
| evaporation temperature /℃ | condensation temperature /℃ | discharge temperature | volumetric cooling capacity | energy efficiency ratio |
| -10 | 56 | 114.45 | 3800 | 3.34 |
| -15 | 56 | 121.12 | 3317 | 3.15 |
| -20 | 56 | 129.02 | 2880 | 2.97 |
| -25 | 56 | 138.53 | 2487 | 2.81 |

Fig.4

| working condition | | cooling system with ejector arranged on suction side of compressor | | |
|---|---|---|---|---|
| evaporation temperature /℃ | condensation temperature /℃ | discharge temperature | volumetric cooling capacity | energy efficiency ratio |
| -10 | 56 | 116.59125 | 3829.25 | 3.348 |
| -15 | 56 | 124.6975 | 3321.5 | 3.177 |
| -20 | 56 | 134.345 | 2916.5 | 2.988 |
| -25 | 56 | 146.0225 | 2521.25 | 2.825 |

Fig.5

| working condition | | cooling system with ejector arranged on discharge side of compressor | | |
|---|---|---|---|---|
| evaporation temperature /℃ | condensation temperature /℃ | discharge temperature | volumetric cooling capacity | energy efficiency ratio |
| -10 | 56 | 110.1675 | 3858.5 | 3.365 |
| -15 | 56 | 113.965 | 3326 | 3.23 |
| -20 | 56 | 118.37 | 2953 | 3.025 |
| -25 | 56 | 123.545 | 2555.5 | 2.855 |

Fig.6

REFRIGERATION SYSTEM

FIELD

The present disclosure belongs to the technical field of cooling technology, and specifically provides a cooling system.

BACKGROUND

A cooling system is a system that can lower an indoor ambient temperature, and is generally used in shopping malls, office buildings, etc. In the hot summer, the indoor environment temperatures of shopping malls, office buildings and the like are very high, and will affect the user experience. Then, the cooling system needs to be used to cool the room, and an evaporation temperature range set during cooling is generally −10° C. to −25° C.

In the prior art, while improving the cooling capacity of the cooling system, the energy efficiency ratio of the cooling system must also be considered, so as to ensure that the cooling capacity of the cooling system can be improved and the cooling system can be more energy-saving. Therefore, in many existing cooling systems, two-stage compressors or air-supplementing enthalpy-increasing compressors have been used, which can improve the energy efficiency ratio of the cooling system to a certain extent. However, the costs of the two-stage compressors and air-supplementing enthalpy-increasing compressors are both very high, and the structures are complicated, making them not easy to repair. Therefore, in order to reduce the cost and further improve the energy efficiency ratio of the cooling system, an ejector may be added to the cooling system. For example, in a document with patent number 201711445292.X, an air conditioning system is provided, in which an ejector is arranged at a suction port of the compressor so as to improve the energy efficiency ratio of the cooling system through the action of the ejector. However, due to the unstable airflow of the ejector, arranging the ejector at the suction port of the compressor will easily affect the stability of the compressor during operation, thereby having an influence on the service life of the compressor. Moreover, this arrangement of the ejector may also cause a suction temperature of the compressor to be overly high, which will affect properties of the compressor oil and affect the safety of the compressor's operation.

Accordingly, there is a need for a new cooling system in the art to solve the above-mentioned problem.

SUMMARY

In order to solve the above-mentioned problem in the prior art, that is, to solve the problem that the arrangement of the ejector at the suction port of the compressor in existing cooling systems will easily affect the stability and safety of the compressor during operation, the present disclosure provides a cooling system, which includes an evaporator, a condenser, a throttling device, a compressor, an economizer and an ejector, wherein the condenser, the economizer, the throttling device, the evaporator, the compressor and the ejector together constitute a closed-loop refrigerant circulation circuit, the ejector is connected to the economizer, and the ejector is arranged on a discharge side of the compressor.

In a preferred technical solution of the above cooling system, the cooling system further includes a gas-liquid separator, which is connected to the refrigerant circulation circuit, and which is arranged between the evaporator and the compressor.

In a preferred technical solution of the above cooling system, the cooling system further includes an oil separator, which is connected to the refrigerant circulation circuit, and which is arranged between the compressor and the ejector.

In a preferred technical solution of the above cooling system, the throttling device is arranged between the economizer and the evaporator.

In a preferred technical solution of the above cooling system, the throttling device is arranged between the economizer and the condenser.

In a preferred technical solution of the above cooling system, the throttling device is an electronic expansion valve.

It can be understood by those skilled in the art that in the preferred technical solutions of the present disclosure, by connecting the ejector to the economizer, the ejector is enabled to mix a low-pressure fluid with a high-pressure fluid, and a turbulent diffusion effect of the jet can be utilized to increase the pressure of output fluid, so as to achieve the effect of two-stage pressurizing, and improve the energy efficiency ratio of the cooling system. Moreover, by arranging the ejector on the discharge side of the compressor, at the same time of achieving two-stage pressurizing of the cooling system, the stability of the compressor's operation will not be affected due to the unstable airflow of the ejector; also, the properties of the compressor oil will not be affected, and the safety of the compressor's operation will not be affected.

BRIEF DESCRIPTION OF THE DRAWINGS

FIG. 2 is a cooling data table of a common cooling system in the prior art;

FIG. 3 is a cooling data table of a two-stage compression cooling system in the prior art;

FIG. 4 is a cooling data table of an air-supplementing enthalpy-increasing cooling system in the prior art;

FIG. 5 is a cooling data table of a cooling system in which an ejector is arranged on a suction side of the compressor in the prior art; and FIG. 6 is a cooling data table of a cooling system in which an ejector is arranged on a discharge side of the compressor in the present disclosure.

DETAILED DESCRIPTION

Figure 1:
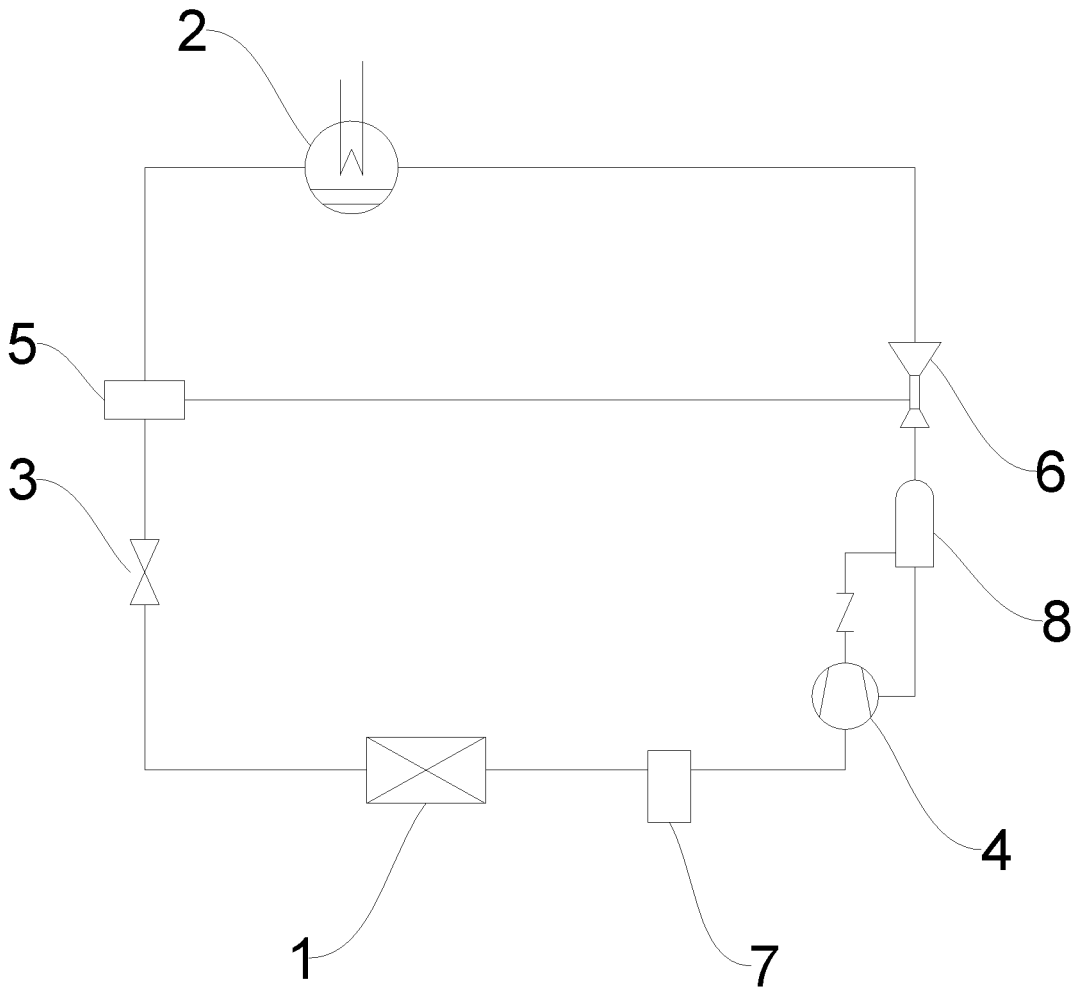
FIG. 1 is a schematic structural view of a cooling system of the present disclosure.

Preferred embodiments of the present disclosure will be described below with reference to the drawings. It should be understood by those skilled in the art that these embodiments are only used to explain the technical principles of the present disclosure, and are not intended to limit the scope of protection of the present disclosure.

Based on the problem pointed out in the "BACKGROUND OF THE INVENTION" that the arrangement of the ejector at the suction port of the compressor in existing cooling systems will easily affect the stability and safety of the compressor during operation, the present disclosure provides a cooling system which aims to, at the same time of achieving two-stage pressurizing by an ejector, not affect the stability of the compressor's operation due to the unstable airflow of the ejector, and meanwhile not affect the properties of the compressor oil and the safety of the compressor's operation.

Specifically, as shown in FIG. 1, the cooling system of the present disclosure includes an evaporator 1, a condenser 2, a throttling device 3, a compressor 4, an economizer 5 and an ejector 6. The condenser 2, the economizer 5, the throttling device 3, the evaporator 1, the compressor 4 and the ejector 6 together constitute a closed-loop refrigerant circulation circuit. The ejector 6 is connected to the economizer 5, and the ejector 6 is arranged on a discharge side of the compressor 4. The condenser 2 is connected to the economizer 5 through a pipeline, and the economizer 5 is connected to the evaporator 1 through a pipeline. The evaporator 1 is connected to the compressor 4 through a pipeline, and the compressor 4 is connected to the ejector 6 through a pipeline. The ejector 6 is connected to the condenser 2 through a pipeline, and the throttling device 3 may be connected between the evaporator 1 and the economizer 5, or between the condenser 2 and the economizer 5. With such an arrangement, the condenser 2, the economizer 5, the throttling device 3, the evaporator 1, the compressor 4 and the ejector 6 can jointly constitute a closed-loop refrigerant circulation circuit. In addition, the economizer 5 is also connected to the ejector 6 through a separate pipeline. During the cooling process of the cooling system, the liquid-phase refrigerant flowing out of the condenser 2 is divided into two parts in the economizer 5. A first part of the refrigerant continues to flow to the evaporator 1, and a second part of the refrigerant is diverted to the ejector 6. The first part of the refrigerant becomes a gas-phase refrigerant after passing through the evaporator 1. The gas-phase refrigerant continues to pass through the compressor 4 and then becomes a high-pressure gas-phase refrigerant. The ejector 6 receives the second part of the refrigerant from the economizer 5 and the high-pressure gas-phase refrigerant from the compressor 4. The pressure of the second part of the refrigerant from the economizer 5 is less than that of the high-pressure gas-phase refrigerant from the compressor 4. The two refrigerants with different pressures and different phases are mixed in the ejector 6, and a mixed shock wave phenomenon occurs in the ejector 6, so that the pressure of the refrigerant from the ejector 6 increases sharply. Therefore, under a joint action with the compressor 4, a two-stage pressurizing effect is realized. It should be noted that the economizer 5 is a heat exchanger, and its function is to absorb heat by throttling and evaporating the refrigerant itself, so that another part of the refrigerant is supercooled.

Preferably, the cooling system further includes a gas-liquid separator 7, which is connected to the refrigerant circulation circuit and which is arranged between the evaporator 1 and the ejector 6. In other words, the gas-liquid separator 7 is arranged on the suction side of the compressor 4 and on the discharge side of the evaporator 1. With such an arrangement, the gas-liquid separator 7 prevents the liquid-phase refrigerant from being suctioned onto the suction side of the compressor 4 to generate liquid hammer, which would otherwise damage the compressor 4.

Preferably, the cooling system further includes an oil separator 8, which is connected to the refrigerant circulation circuit and which is arranged between the compressor 4 and the ejector 6. In other words, the oil separator 8 is arranged on the discharge side of the compressor 4 and on the suction side of the ejector 6. During the operation of the compressor 4, the refrigerant and lubricating oil in the compressor 4 are vaporized into a mixture. After the mixture leaves the compressor 4, the lubricating oil in the compressor 4 is reduced. Through the action of the oil separator 8, the lubricating oil can be returned to an oil storage tank of the compressor 4 to prevent the compressor 4 from having a failure due to lack of the lubricating oil, so that the service life of the compressor 4 is prolonged.

In the present disclosure, the throttling device 3 may be an electronic expansion valve, a manual expansion valve, or a capillary tube. Those skilled in the art may flexibly set the specific structure of the throttling device 3 in practical applications. The adjustments and changes to the specific structure of the throttling device 3 do not constitute limitations to the present disclosure, and should be covered within the scope of protection of the present disclosure.

After repeated experiments, comparisons and analysis by the inventor, as compared with the ordinary cooling systems, the two-stage compression cooling systems, the air-supplementing enthalpy-increasing cooling systems, and the cooling systems in which the ejector 6 is arranged on the suction side of the compressor 4 in the prior art, the energy efficiency ratio is significantly improved by using the cooling system of the present disclosure. Since the evaporation temperature range set when the cooling system is used for cooling is generally −10° C. to −25° C., four evaporation temperature values of −10° C., −15° C., −20° C. and −25° C. are specially selected for comparison and analysis between the energy efficiency ratio of the cooling system of the present disclosure and the energy efficiency ratio of the cooling system in the prior art.

As shown in FIGS. 2 and 6, the energy efficiency ratio of the cooling system of the present disclosure is greatly improved as compared with the energy efficiency ratio of the ordinary cooling system in the prior art. According to calculations, the energy efficiency ratio can be improved by up to 18%.

As shown in FIGS. 3 and 6, the energy efficiency ratio of the cooling system of the present disclosure is also greatly improved as compared with the two-stage compression cooling system in the prior art. According to calculations, the energy efficiency ratio can be improved by up to 12.7%.

As shown in FIGS. 4 and 6, the energy efficiency ratio of the cooling system of the present disclosure is obviously improved as compared with the air-supplementing enthalpy-increasing cooling system in the prior art. According to calculations, the energy efficiency ratio can be improved by up to 2.54%.

As shown in FIGS. 5 and 6, the energy efficiency ratio of the cooling system of the present disclosure is obviously improved as compared with the cooling system in which the ejector 6 is arranged on the suction side of the compressor 4 in the prior art. According to calculations, the energy efficiency ratio can be improved by up to 1.67%.

It can be seen from the above that the cooling system of the present disclosure not only can achieve two-stage pressurizing, but also will not affect the stability of the operation of the compressor 4 due to the unstable airflow of the ejector 6, when compared with the cooling system in which the ejector 6 is arranged on the suction side of the compressor 4 in the prior art; also, the properties of the compressor oil will not be affected, and the safety of the operation of the compressor 4 will not be affected. Moreover, the energy efficiency ratio of the cooling system during cooling is obviously higher than that of any type of cooling system in the prior art, thereby ensuring that the cooling system of the present disclosure has a very high cooling capacity and is also more energy-saving.

Hitherto, the technical solutions of the present disclosure have been described in conjunction with the accompanying drawings, but it is easily understood by those skilled in the art that the scope of protection of the present disclosure is obviously not limited to these specific embodiments. Without departing from the principle of the present disclosure, those skilled in the art can make equivalent changes or replacements to relevant technical features, and the technical solutions after these changes or replacements will fall within the scope of protection of the present disclosure.

What is claimed is:

1. A cooling system, comprising:

an evaporator;

a condenser;

a throttling device;

a compressor;

an economizer; and an ejector, wherein the condenser, the economizer, the throttling device, the evaporator, the compressor, and the ejector together form a closed-loop refrigerant circulation circuit, the ejector is connected to the economizer, the ejector is arranged on a discharge side of the compressor, wherein during a cooling process of the cooling system, a liquid-phase refrigerant flowing out of the condenser is divided into a first liquid-phase part and a second liquid-phase part in the economizer; wherein the first liquid-phase part of the refrigerant continues to flow to the evaporator, becomes a gas-phase refrigerant after passing through the evaporator, the gas-phase refrigerant continues to pass through the compressor and then becomes a high-pressure gas-phase refrigerant; wherein the second liquid-phase part of the refrigerant is diverted to the ejector, the ejector receives the second liquid-phase part of the refrigerant from the economizer and the high-pressure gas-phase refrigerant from the compressor, wherein the pressure of the second liquid-phase part of the refrigerant from the economizer is less than that of the high-pressure gas-phase refrigerant from the compressor; and wherein the second liquid-phase part of the refrigerant and the high-pressure gas-phase refrigerant are mixed in the ejector, and a mixed shock wave phenomenon occurs in the ejector, so that the pressure of the refrigerant from the ejector increases sharply to realize a two-stage pressurizing effect under a joint action with the compressor.

2. The cooling system according to claim 1, further comprising a gas-liquid separator, which is connected to the refrigerant circulation circuit, and which is arranged between the evaporator and the compressor.

3. The cooling system according to claim 1, further comprising an oil separator, which is connected to the refrigerant circulation circuit, and which is arranged between the compressor and the ejector.

4. The cooling system according to claim 1, wherein the throttling device is arranged between the economizer and the evaporator.

5. The cooling system according to claim 1, wherein the throttling device is arranged between the economizer and the condenser.

6. The cooling system according to claim 1, wherein the throttling device is an electronic expansion valve.

7. The cooling system according to claim 2, wherein the throttling device is an electronic expansion valve.

8. The cooling system according to claim 3, wherein the throttling device is an electronic expansion valve.

9. The cooling system according to claim 4, wherein the throttling device is an electronic expansion valve.

10. The cooling system according to claim 5, wherein the throttling device is an electronic expansion valve.

* * * * *